US006340283B1

(12) United States Patent
Hedger et al.

(10) Patent No.: US 6,340,283 B1
(45) Date of Patent: Jan. 22, 2002

(54) ADJUSTABLE IMPINGEMENT DUAL BLOWER APPARATUS

(75) Inventors: Thomas A. Hedger, Largo; Jeff Neal Bullock, Riverview, both of FL (US)

(73) Assignee: Graves Spray Supply, Inc., Clearwater, FL (US)

( * ) Notice: Subject to any disclaimer, the term of this patent is extended or adjusted under 35 U.S.C. 154(b) by 0 days.

(21) Appl. No.: 09/652,886

(22) Filed: Aug. 31, 2000

(51) Int. Cl.[7] ..... F04D 25/16

(52) U.S. Cl. ..... 415/60; 415/121.2; 415/126; 415/213.1; 416/63; 416/246; 416/247 R

(58) Field of Search ..... 415/60, 102, 121.2, 415/126, 213.1, 220; 416/63, 244 R, 246, 247 R

(56) References Cited

U.S. PATENT DOCUMENTS

| | | | | | |
|---|---|---|---|---|---|
| 2,653,803 | A | | 9/1953 | Baner | |
| 2,878,991 | A | * | 3/1959 | Berman | 415/124.1 |
| 2,998,714 | A | | 9/1961 | Bonzer | |
| 3,045,450 | A | | 7/1962 | Chandler | |
| 3,150,816 | A | * | 9/1964 | Laing | 415/53.1 |
| 3,903,213 | A | | 9/1975 | Stover | |
| 4,079,665 | A | * | 3/1978 | Martin | 98/33 R |
| 4,239,459 | A | * | 12/1980 | Felter | 417/234 |
| 4,398,452 | A | | 8/1983 | Bradshaw | |
| 4,851,162 | A | | 7/1989 | Sperr, Jr. et al. | |
| 5,042,270 | A | | 8/1991 | Sanchez | |
| 5,277,655 | A | | 1/1994 | Storkan et al. | |
| 5,370,576 | A | | 12/1994 | Krofchalk | |
| 5,598,719 | A | | 2/1997 | Jones et al. | |
| 5,632,677 | A | | 5/1997 | Elkins | |
| 5,643,082 | A | | 7/1997 | Furukawa | |
| 5,658,130 | A | * | 8/1997 | Goldstein et al. | 416/100 |
| 5,788,568 | A | | 8/1998 | Ito et al. | |

* cited by examiner

*Primary Examiner*—Edward K. Look
*Assistant Examiner*—Ninh Nguyen
(74) *Attorney, Agent, or Firm*—Larson & Larson, P.A.; James E. Larson

(57) ABSTRACT

A pair of high speed blowers are pivotally mounted in a vertical plane on a movable frame structure. Each blower has blades turning in an opposite direction from the other blower. The blowers are locked in place at an angle of 10 to 60 degrees with respect to each other so that air emanating from the blowers impinge on each other downstream from the blowers. The air impingement creates a triangular type expanding air stream pattern downstream from the impingement area.

20 Claims, 8 Drawing Sheets

ADJUSTABLE IMPINGEMENT DUAL BLOWER APPARATUS

BACKGROUND OF THE INVENTION

The invention relates to a forced air flow ventilation system. More specifically, it refers to the employment of two or more blowers mounted on a frame having an air flow pattern such that the air from separate blowers turning in different directions impinge upon each other at varying angles to produce a wide fan pattern of air.

Typically, prior art fans or blowers are mounted to expel blown air directly in front of the blower. In U.S. Pat. No. 5,370,576 a pair of truck cab blowers are mounted one above the other to force outside air into the truck cab. Fan housing cover plates are pivoted to either an open or closed position. Air flow adjustment members 74 and 76 are rotated to independently adjust the air discharge direction. There is no suggestion for rotating the air flow adjustment members so that the air flow from separate blowers impinge upon each other. In U.S. Pat. No. 5,643,082, a series of blowers or fans are installed in a building wall in separate frames. Each blower emits an air stream into the building directly from the front of the blower. There is no air flow from adjacent blowers that impinge upon each other.

The air flow pattern from separate blowers is limited by the size of the blower and the position of the blower with respect to its target. A system is needed which will extend the flow pattern to a wider area from a given number of blowers.

SUMMARY OF THE INVENTION

The present invention provides a system for expanding the flow pattern of a pair of blowers so that a greater area is affected by the impingement of the blower air streams. Therefore, the air flow area covered by the two impinging air streams is greater than the sum of the air streams for the two blowers acting independently, side by side.

A pair of blowers are pivotally mounted one above the other in a vertical frame structure. The fan blades in one blower turn clockwise and the fan blades in the other blower turn counterclockwise. The blowers have a protective grate in front of multiple blades, but no other structure impedes the flow of air from each blower. The blowers are locked in place at an angle of 10 to 60 degrees with respect to each other so that air emanating from the blowers impinge on each other at a point spaced from the front of the blowers. This impingement creates a fan-like pattern that expands outwardly and downstream from the impingement point.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
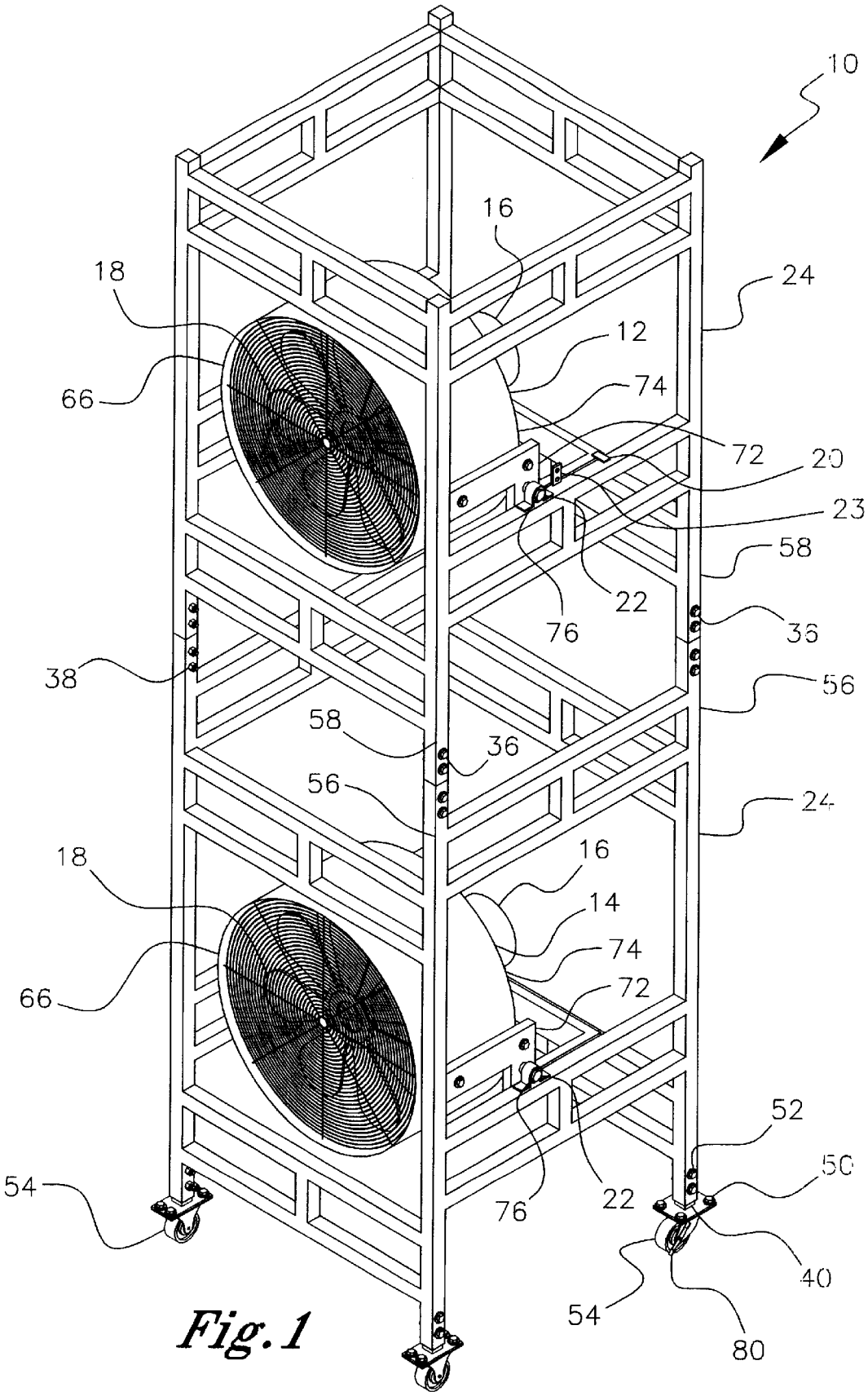
FIG. 1 is a front perspective view of a movable frame structure on which is mounted two blowers.

Throughout the following detailed description, the same reference numerals refer to the same elements in all figures.

Figure 2:
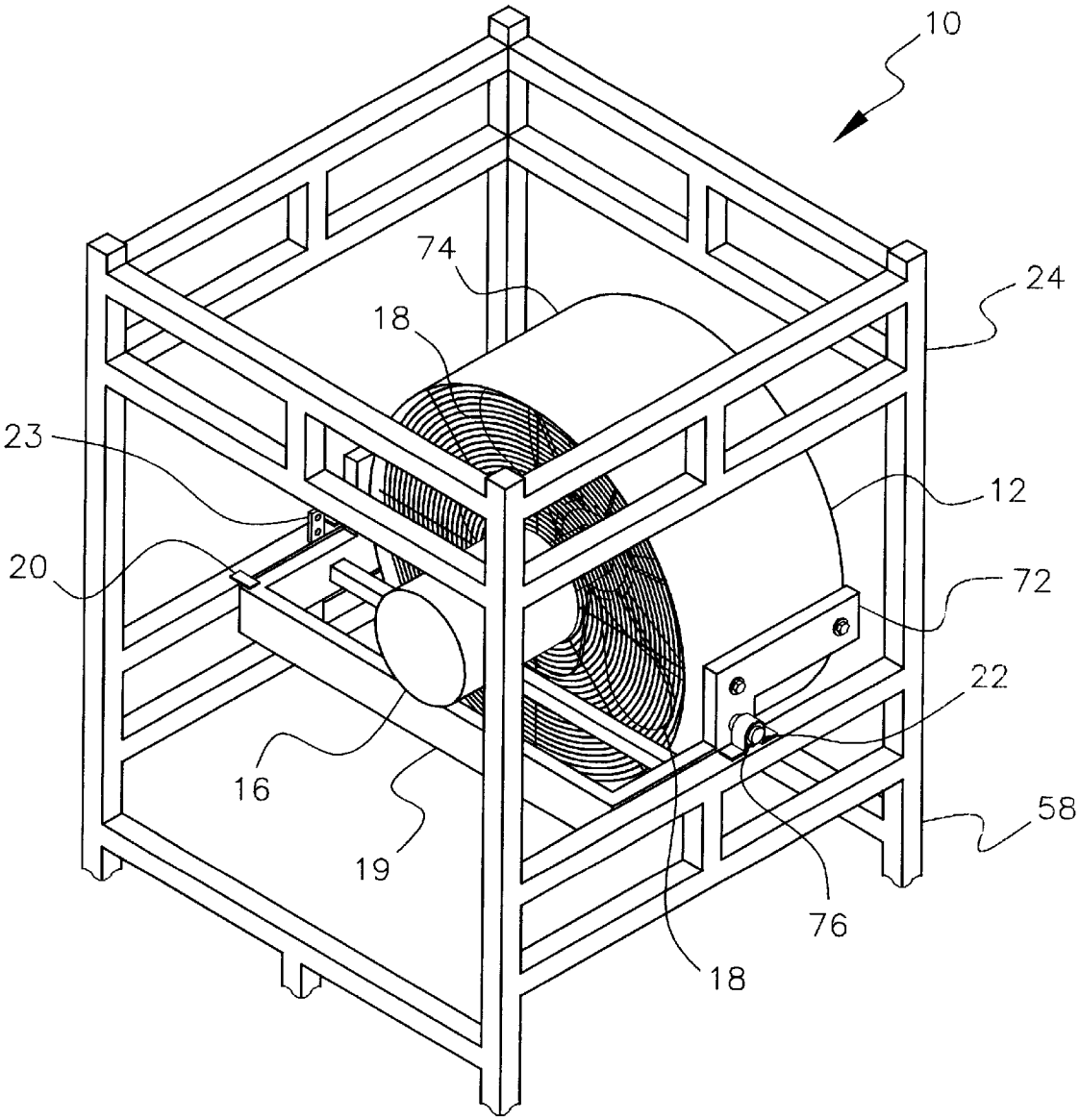
FIG. 2 is a back perspective view of a single blower locked within the movable frame structure of FIG. 1.
Figure 3:
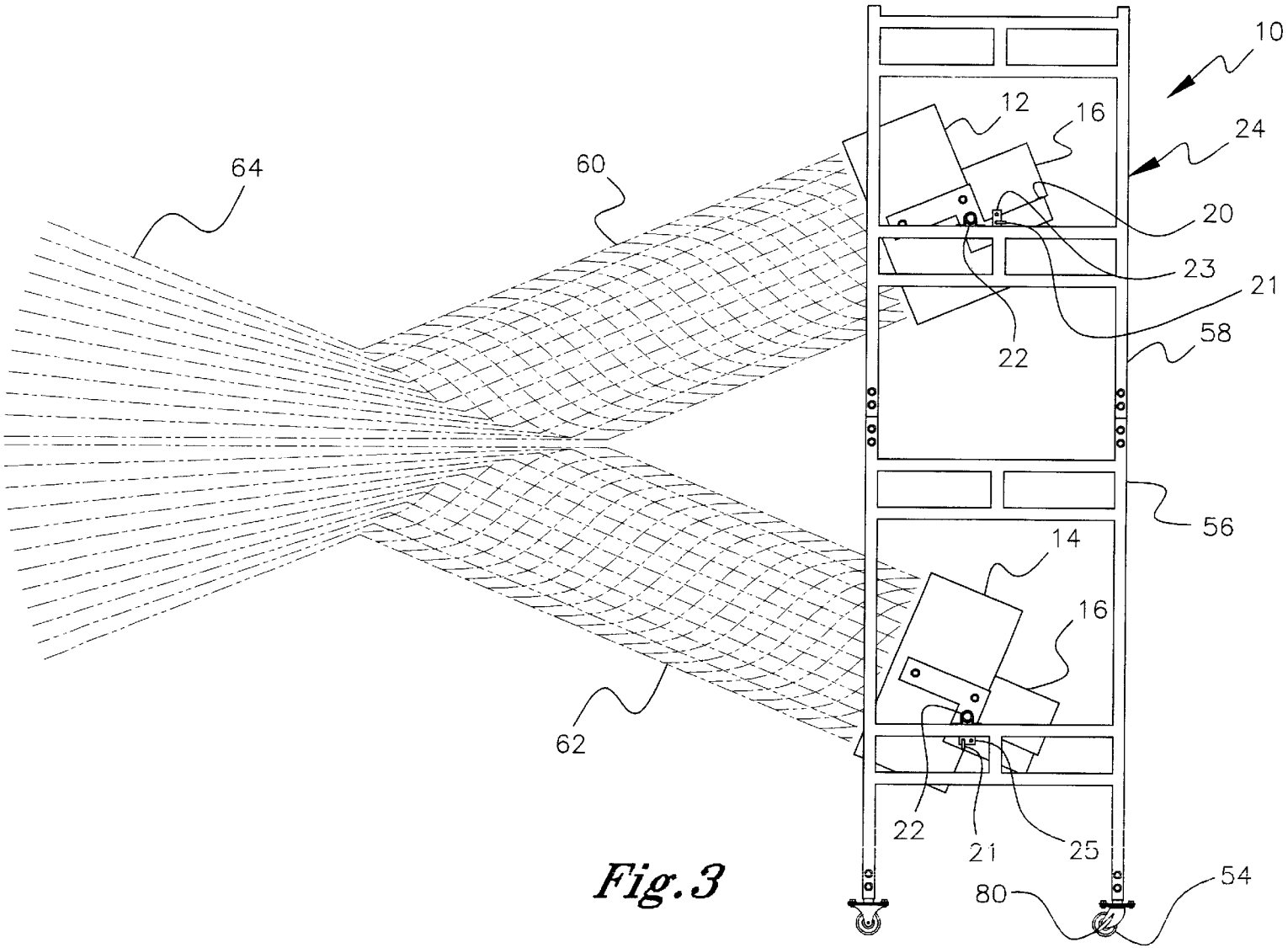
FIG. 3 is a diagrammatic view of an air stream fan-like pattern produced from impinging air streams from a pair of blowers.
Figure 6:
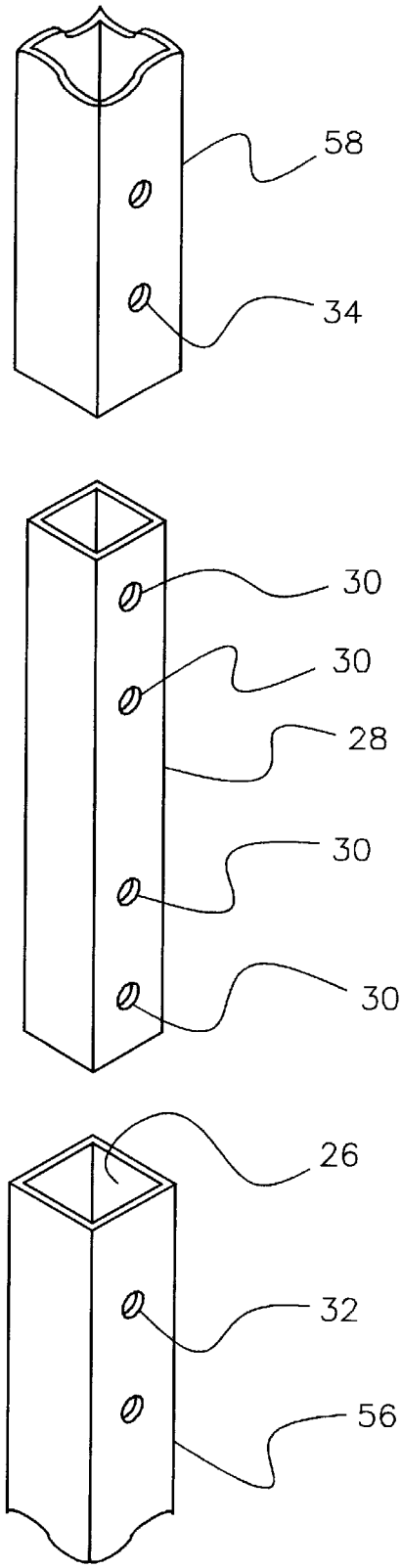
FIG. 6 is an exploded view of the frame elements for the blower mounting structure.

The movable frame structure 10 of FIGS. 1 and 2 has a first blower 12 and a second blower 14 pivotally mounted therein. A motor 16 powers each blower having seven fan blades 18. More or less fan blades can be employed. One blower has blades 18 turning clockwise and the other counterclockwise. A flange 20 extension on a blower support 19 retains the blower 12 in a first position. Pin 21 inserted into holes on a side plate 23 cause the blower to point downward at one of two different angles. Likewise, a corresponding side plate 25 with pin 21 inserted can angle blower 14 upwardly as shown in FIG. 3. Each blower is mounted within an integral cage structure 24. The cage structures 24 are composed of tubular elements 56 and 58 having a hollow interior portion 26 for receiving connector elements 28 as shown in FIG. 6. Each connector element 28 has through bores 30 for alignment with bore 32 in a lower cage structure element 56 and to bores 34 in an upper cage structure element 58. Through bolts 36 held in place by nuts 38 provide a connection with element 28 between top 58 and bottom 58 cage structure.

Figure 7:
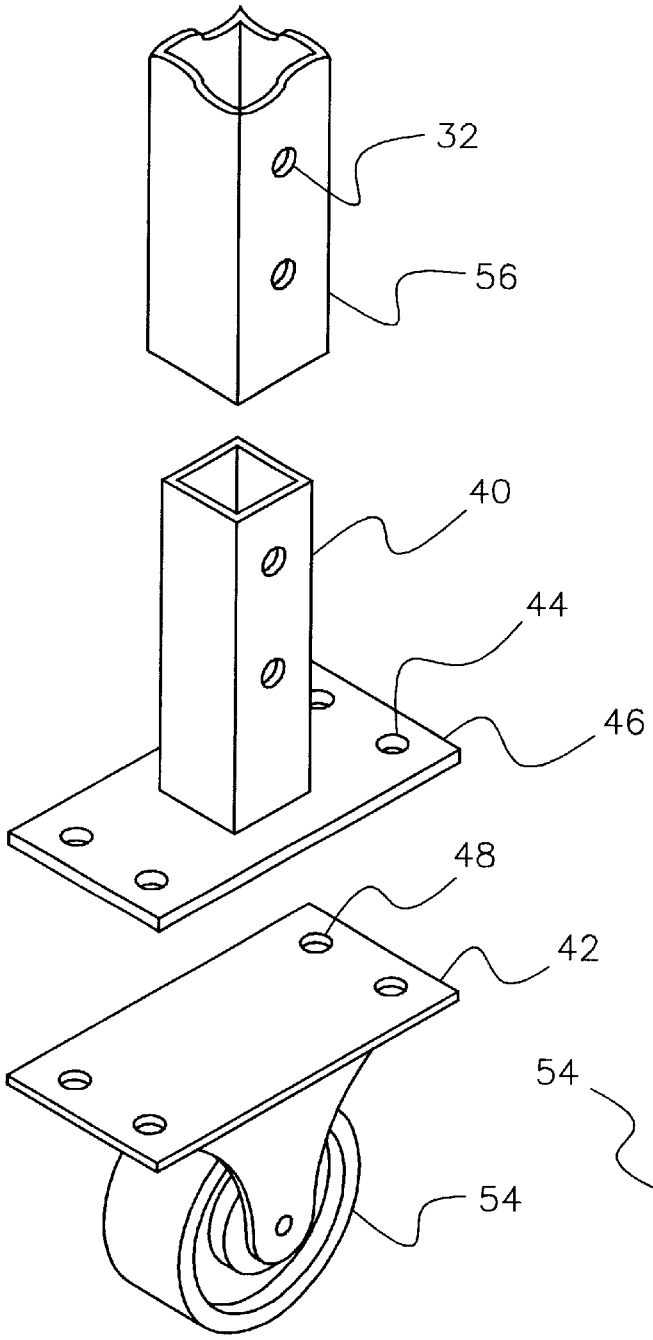
FIG. 7 is an exploded view of the bottom frame elements for the blower mounting structure.
Figure 8:
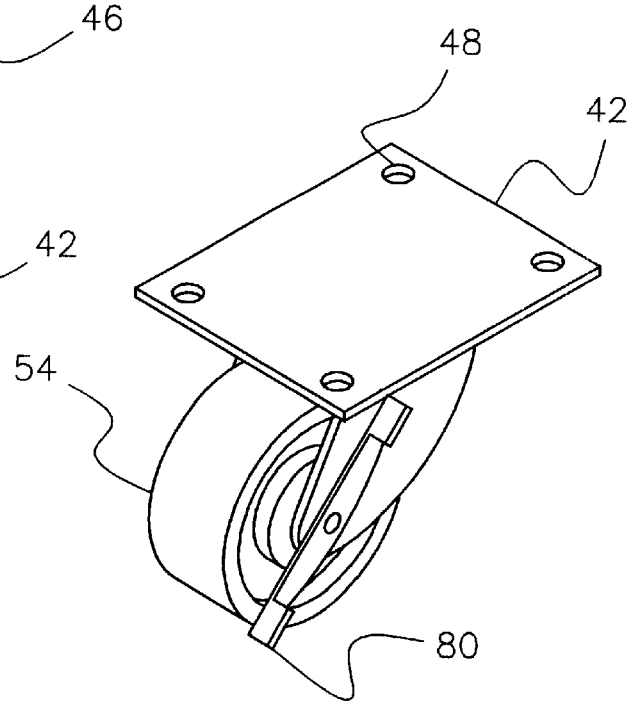
FIG. 8 is perspective view of another bottom frame element for the blower mounting structure.

FIGS. 7 and 8 show a connector 40 which engages a wheel mounting structure plate 42. Bores 44 in plate 46 at the base of connector 40 are aligned to bores 48 in plate 42. Bolts 50 attach the plates 42 and 46 together. Bolts 52 attach the bottom cage structure 56 to the connector 40. Wheels 54 are used to move frame structure 10. Brake 80 prevents further movement of frame structure 10.

Figure 5:
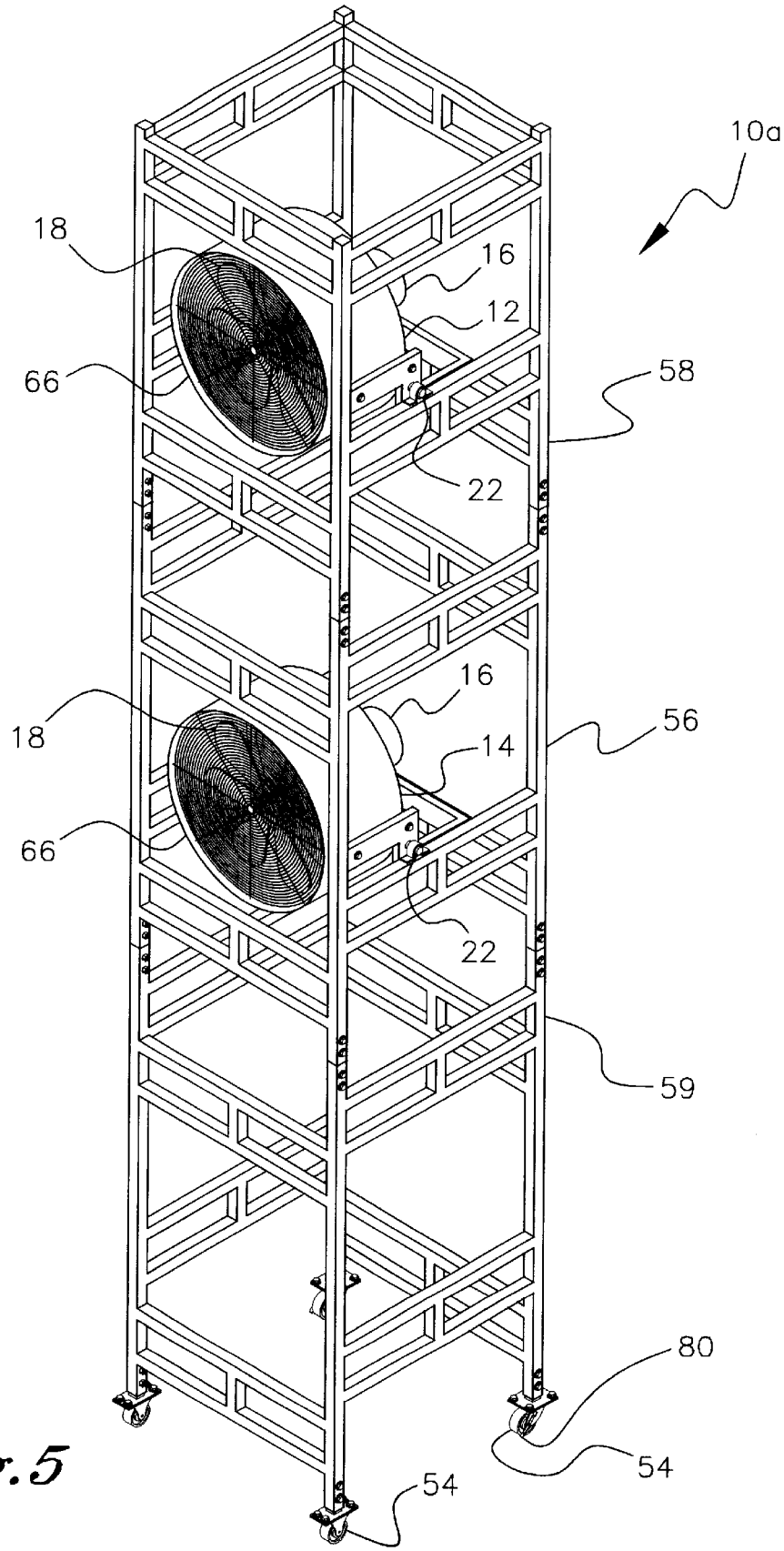
FIG. 5 is a front perspective view of an expanded frame structure for mounting blowers.

FIG. 5 shows an expanded frame structure **10*a* which could accommodate a third blower enclosed within cage structure 59, or merely can be used to raise the blowers 12 and 14** to a higher level.

Figure 4:
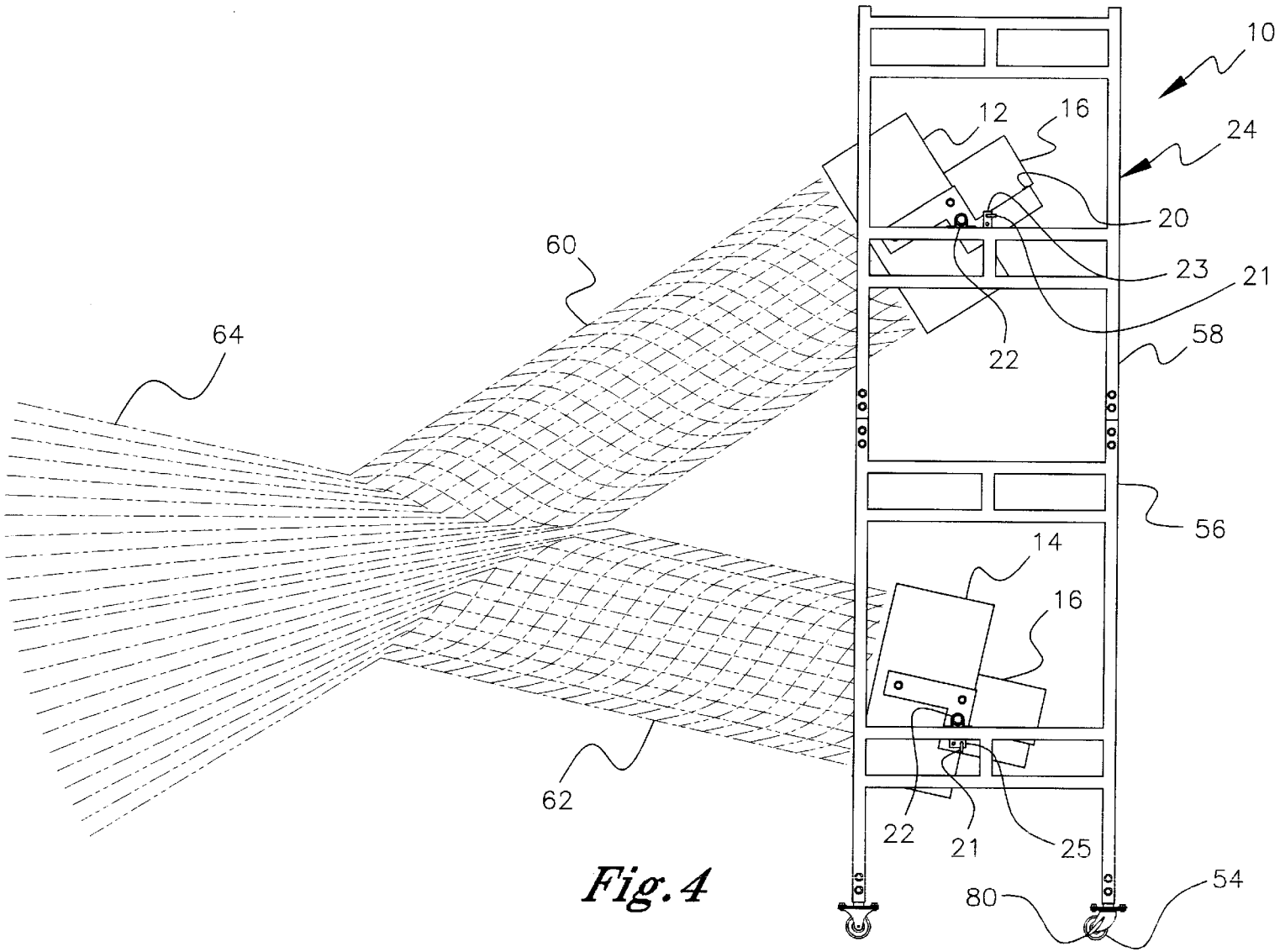
FIG. 4 is a diagrammatic view of an air stream fan-like pattern produced from an impinging air stream as in FIG. 3, but with a different angle position of the blowers.

FIGS. 3 and 4 show the blowers 12 and 14 angled toward each other so that airstream 60 from blower 12 impinges on airstream 62 from blower 14 causing a fan-like pattern 64 of expanded air flow to be produced.

The impingement blowers 12 and 14 employed in this invention are driven by about a one h.p. motor 16. The diameter of the blower front face 66 can vary from 10 inches to 42 inches. The following is a range of the air flow in cubic feet per minute (CFM) and feet per minute (FPM) for typical diameter blowers.

12 inch diameter blower:
5,000–9,000 CFM
3,000–6,000 FPM 24 inch diameter blower:
6,000–12,000 CFM
2,000–5,000 FPM 36 inch diameter blower:

8,000–20,000 CFM

800–2,500 FPM

The impingement angle between blowers 12 and 14 to obtain a maximum airflow 64 is 10 degrees to 60 degrees.

Figure 9:
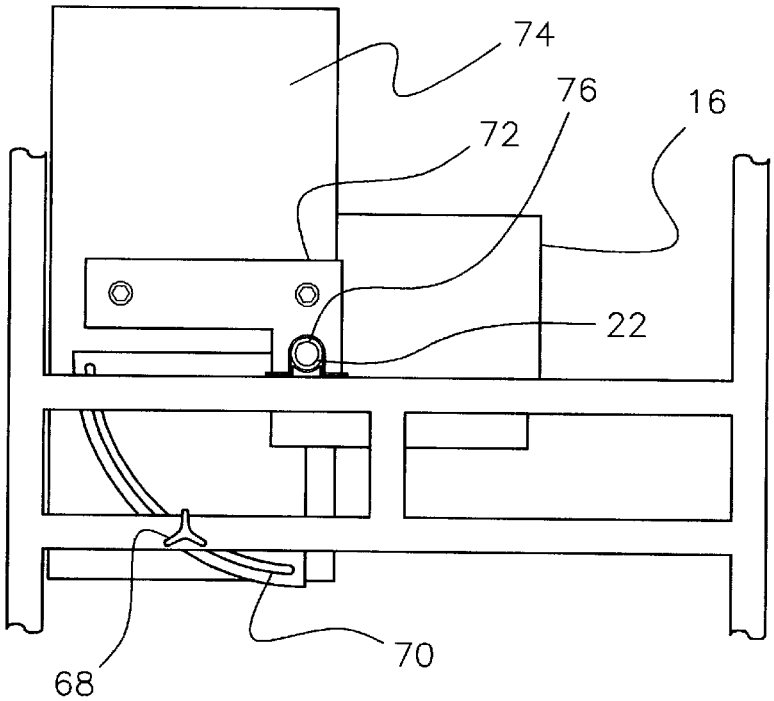
FIG. 9 is a side view of a blower locked within its frame structure, but with an alternate locking mechanism as compared to FIG. 2.
Figure 10:
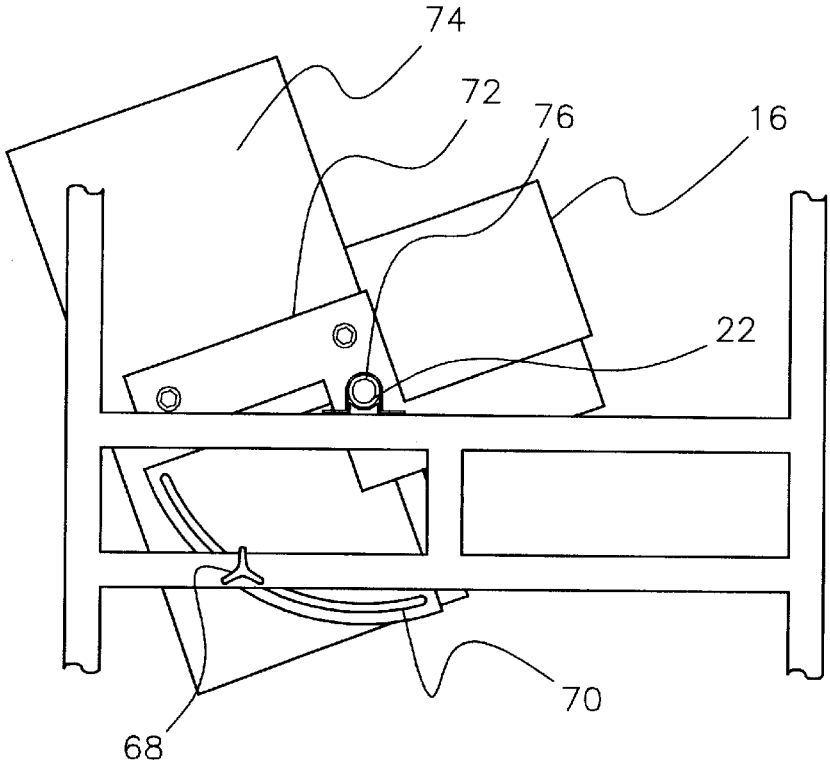
FIG. 10 is a side view of a blower as in FIG. 9 with the blower adjusted to a different angle.

FIGS. 1 and 2 show adjustment of the blower angle and locking with pins 21 in the holes of side plate 23 or 25. FIGS. 9 and 10 show an alternate means of adjustment of the blower angle and locking with a screw-down handle 68 positioned within slot 70. The pivot point 22 remains the same for either adjustment means. A plate 72 bolted to the blower outer housing 74 supports rod 76 which rotates at pivot point 22.

The wide air flow 64 generated by the impingement of flow 60 and 62 is carried out without the need for louvers or external duct work. Thus, there is an uninterrupted flow of air from each blower to the impingement site where the flow expands outwardly.

In the use of this invention, for example, two eighteen inch diameter high velocity blowers directed at each other at an angle of 30 degrees produces an air flow fan pattern of 40–50 feet in width from a distance 50 feet away from the blowers. The exact air flow air pattern will vary depending on the adjusted impingement angle between the blowers 12 and 14.

By making the impingement angle adjustable it allows the user to make adjustments in pattern width and projected air velocity of the air pattern so an entire work area is in compliance with O.S.H.A. regulations. The use of this device replaces the costly and only partially effective workplace duct/vent configurations. Since the two blowers are mounted on a movable frame they are portable. Unlike the duct work which is typically permanent, the mobile impinging blowers of this invention offers the end user a much higher degree of flexibility when trying to address a workplace concerned with air movement. Also, unlike prior art duct work installations, the impinging air streams of this invention produce a wide uniform air flow that does not have any "dead spots" where air movement is absent.

Another application for the adjustable impinging blowers is evaporative cooling applications. The blowers 12 and 14 would work similar to an atomizing spray gun air cap but on a much larger scale. They could be adjustable to introduce a liquid stream of water into the intersection point of the air streams 60 and 62 and obtain superior atomization of the water which would aid in evaporative cooling applications as shown in U.S. Pat. No. 5,643,082, incorporated herein by reference. In fact, for super fine atomization of the liquid, the water could be first atomized by conventional methods such as primary air atomization or hydraulic (airless high pressure) atomization and then directed into the intersection point of air streams 60 and 62 from the blowers 12 and 14 respectively, where the water would go through secondary atomization reducing it to an even smaller droplet size and distributing the droplets evenly throughout the air pattern 64 produced by the two blower air streams 60 and 62. Again, because the blowers are adjustable the evaporative cooling air pattern could be directed over a large area to cool it very effectively. The large flow rates of air produced by the blowers also could handle extremely high flow rates of water without sacrificing atomization quality. It is possible for the aforementioned type of system to be used effectively for the manufacturing of artificial snow. A large scale adjustable impinging blower system could be used with a high volume water supply to greatly speed up the manufacture and placement of artificial snow in an extremely large area. Present systems utilize single jet atomization orifices which take mm more time to cover an area since the pattern produced is circular and the volume of water handled is much lower.

A stop or brake 80 shown in FIG. 8 is used to prevent movement of the structure 10 when a fixed mode is desired.

Other equivalent elements can be substituted for the elements disclosed herein to produce the same results in the same way.

Having disclosed the invention, what is claimed follows:

1. An adjustable dual blower air impingement blower apparatus mounted on a frame structure having a protective safety grating in front of multiple blades in each of the dual blowers and no other obstruction to a stream of air emanating from each of the dual blowers, the apparatus further comprising:

(a) a means for pivoting each blower to a desired angle towards its mating blower on the frame structure;

(b) a means for locking each blower in place at an angle towards its mating blower, and (c) each blower having blades turning in a direction opposite the other blower and emitting a solid stream of air towards an impingement area, the impingement of the solid stream of air from each blower creating a triangular type expanding air stream pattern downstream from the impingement area.

2. The adjustable dual blower air impingement blower apparatus according to claim 1 wherein the blowers are mounted on a vertical plane on the frame structure.

3. The adjustable dual blower air impingement blower apparatus according to claim 2 wherein the dual blowers are pivoted at an angle of 10 to 60 degrees with respect to each other.

4. The adjustable dual blower air impingement blower apparatus according to claim 3 wherein the blowers are powered by about a 1 h.p. motor.

5. The adjustable dual blower air impingement blower apparatus according to claim 3 wherein the blowers have a diameter of ten to forty-two inches.

6. The adjustable dual blower air impingement blower apparatus according to claim 1 wherein the means for locking each blower in place is a pin mounted in a side plate of the blower.

7. The adjustable dual blower air impingement blower apparatus according to claim 1 wherein the means for locking each blower in place is a locking screw connecting a side of the frame structure to a curved slot in a housing for the blower.

8. An adjustable dual blower air impingement blower apparatus comprising:

(a) a frame structure connected together in a vertical plane;

(b) a first blower having multiple blades turning clockwise, the first blower pivotally mounted in a lower portion of the frame structure;

(c) a second blower having multiple blades turning counterclockwise, the second blower pivotally mounted in an upper portion of the frame structure;

(d) a means for locking the first blower and the second blower at a desired angle towards each other so that an air stream emanating from the first blower intersects an air stream emanating from the second blower at an impingement area, the impinging air stream creating a triangular type expanding air stream pattern downstream from the impingement area, and (e) the first and second blower each having a protective grate in front of the multiple blades and no other obstruction impeding the flow of air from the blower.

9. An adjustable dual blower air impingement blower apparatus according to claim 8 wherein the first and second blowers are locked in place at an angle of 10 to 60 degrees with respect to each other.

10. An adjustable dual blower air impingement blower apparatus according to claim 9 wherein each of the first and second blower is locked in place by a pin mounted in a side plate of the blower.

11. An adjustable dual blower air impingement blower apparatus according to claim 9 wherein each of the first and second blower has a curved slot in a housing side wall and a screw connects each blower to the frame structure at a desired position on the curved slot.

12. An adjustable dual blower air impingement blower apparatus according to claim 9 wherein the frame structure is movable on wheels.

13. An adjustable dual blower air impingement blower apparatus comprising:

(a) a vertically constructed frame structure adapted to mount at least two blowers;

(b) a first blower having multiple blades turning clockwise, the first blower pivotally mounted in a lower portion of the frame structure;

(c) a second blower having multiple blades turning counterclockwise, the second blower pivotally mounted in an upper portion of the frame structure;

(d) a means for locking the first blower and second blower at a preselected angle towards each other so that an air stream emanating from each blower intersect at a distance spaced downstream from a front grate protecting fan blades within the first and second blower; and (e) the air stream from the first and second blower creating an expanding air stream downstream from a point of impingement of the two air streams.

14. The adjustable dual blower air impingement blower apparatus according to claim 13, wherein the preselected angle is 10 to 60 degrees.

15. The adjustable dual blower air impingement blower apparatus according to claim 13 wherein the means for locking the first and second blower is a pin mounted in a side plate of the first and second blower.

16. The adjustable dual blower air impingement blower apparatus according to claim 13, wherein the means for locking the first and second blower is a threaded slot in a side housing of the first and second blower and a locking screw connecting the vertically constructed frame structure to the threaded slot.

17. A method of creating an expanding air flow in a workplace comprising:

(a) pivotally mounting a first and second blower in a vertically constructed frame structure;

(b) providing a means for locking the first and second blower at a preselected angle towards each other;

(c) providing a sufficient source of electrical power to power the first and second blower; and (d) providing a sufficient number of fan blades within the first blower turning clockwise and second blower turning counterclockwise so that an air stream emanating from the first and second blower intersect at a distance spaced downstream from a front grate protecting the fan blades to create an expanding air stream pattern downstream from the intersection of the first and second blower air streams.

18. The method according to claim 17 wherein the power provided to the first and second blower comes from about a one h.p. electric motor.

19. The method according to claim 17 wherein the preselected angle setting on the first and second blower towards each other is 10 to 60 degrees.

20. The method according to claim 17 wherein the vertically constructed frame structure is provided with wheels to enhance mobility of the frame structure.

* * * * *